US005613555A

United States Patent [19]

Sorem et al.

[11] Patent Number: 5,613,555

[45] Date of Patent: Mar. 25, 1997

[54] INFLATABLE PACKER WITH WIDE SLAT REINFORCEMENT

[75] Inventors: Robert M. Sorem, Lawrence, Kans.; David M. Eslinger, Tulsa, Okla.

[73] Assignee: Dowell, a division of Schlumberger Technology Corporation, Sugar Land, Tex.

[21] Appl. No.: 362,628

[22] Filed: Dec. 22, 1994

[51] Int. Cl.[6] ..... E21B 33/127

[52] U.S. Cl. ..... 166/187; 166/195

[58] Field of Search ..... 166/187, 387, 166/195, 120; 277/34

[56] References Cited

U.S. PATENT DOCUMENTS

| | | | |
|---|---|---|---|
| 3,506,068 | 4/1970 | Brown et al. | 166/187 |
| 3,604,732 | 9/1971 | Malone | 166/187 X |
| 4,832,120 | 5/1989 | Coronado | 166/187 |
| 4,892,144 | 1/1990 | Coone | 166/122 |
| 4,923,007 | 5/1990 | Sanford et al. | 166/187 |
| 4,979,570 | 12/1990 | Mody | 166/387 |
| 5,280,824 | 1/1994 | Eslinger et al. | 166/187 |
| 5,353,871 | 10/1994 | Eslinger et al. | 166/187 |
| 5,507,341 | 4/1996 | Eslinger et al. | 166/187 |

*Primary Examiner*—Frank Tsay
*Attorney, Agent, or Firm*—John E. Vick, Jr.

[57] ABSTRACT

A slat-type inflatable packer includes a plurality of longitudinal metal slats on the exterior thereof which are partially overlapping to allow expansion of the packer element while providing a barrier against extrusion. In one embodiment each slat has narrow end portions and a wide central portion to provide greatly increased lateral stiffness as well as improved extrusion barrier and slat deployment characteristics, particularly in high expansion ratio packers, and in another embodiment such characteristics are further improved by upper and lower intermediate sections which are wider than such central portion.

13 Claims, 1 Drawing Sheet

INFLATABLE PACKER WITH WIDE SLAT REINFORCEMENT

FIELD OF THE INVENTION

This invention relates generally to an inflatable packer used in well bore pressuring operations, and particularly to an inflatable packer having an improved slat-type reinforcement on the exterior thereof.

BACKGROUND OF THE INVENTION

An inflatable packer is a normally retracted wellbore sealing device that is expanded into sealing contact with a well conduit wall by pumping fluid under pressure into the interior of the packing unit. When inflation pressure is relieved, the packer unit will inherently retract toward its original diameter so that it can be removed from the well. The packer unit typically includes an inner elastomer bladder that is covered externally by a reinforcement that prevents extrusion of the bladder under pressure and which is the principal load bearing member when the packer is set.

A reinforcement that has been widely used is an assembly of longitudinal, circumferentially overlapped metal slats whose opposite end portions, together with opposite end portions of the bladder, are anchored to annular upper and lower fittings on the packer mandrel. The slats are long and rectangular in shape and have sufficient overlap when the packer unit is retracted that they still completely cover the bladder when the unit is fully expanded to provide a barrier against extrusion of the bladder.

Since the metal slat assembly which forms the reinforcement is the principal load bearing member as well as the extrusion barrier for the inner elastomer bladder, the design of this type packer is directly related to how the slats are to be packaged. The three principal parameters in the design are 1) total cross-section area of slat material 2) extrusion barrier requirement, and 3) slat deployment as the packer unit expands. The first parameter is independent of slat geometry in terms of width and number. However in connection with the second parameter the applicants have found that it is preferable to have numerous thin slats rather than a few thick slats, with the ultimate goal being to have the maximum slat surface area that can be packaged on the end fittings. The third parameter mainly governs the width of each slat. Here it is preferable to have a wider slat which will deploy better during inflation due to increased lateral stiffness. For example a 1 inch wide slat is eight (8) times stiffer than a ½ inch wide slat.

Using the expansion ratio for the packer unit (i.e. the ratio of its expanded and retracted outer diameters) and the differential pressure requirements for a particular type of well service operation, the minimum slat cross-sectional area and surface area can be determined. From these values, the slat width and thickness can also be determined. From the standpoint of slat deployment, it would appear advantageous to have extremely wide but thin slats. However the strain in the slat where it anchors to the end fitting is directly proportional to width. Thus the maximum strain that a slat material can withstand is the principal determining factor of slat width.

With the foregoing factors in view, it is an object of the present invention to provide a new and improved reinforcing slat design for an inflatable well packer which is dimensioned to provide optimum characteristics for load bearing as well as extrusion barrier and deployment.

Another object of the present invention is to provide a new and improved reinforcing slat assembly for use in an inflatable packer and where each slat has one cross-section area at its end portions which will bear the required loads at the end fittings, and another larger cross-sectional area throughout the balance of its length which provides the required extrusion barrier and deployment characteristics.

Still another object of the present invention is to provide a new and improved reinforcing assembly for an inflatable packer where each slat has uniform width end portions and variable width intermediate portions to control packer shape and deployment during inflation.

SUMMARY OF THE INVENTION

These and other objects are attained in accordance with the concepts of the present invention through the provision of a plurality of elongated metal slats which are circumferentially overlapped and arranged around the elastomer bladder of an inflatable packer to provide a load-bearing reinforcement when the bladder is expanded against a surrounding well conduit wall. Each slat is dimensioned such that it has narrow end portions which are connected to the packer end fittings, and a wider central portion which provides an extrusion barrier for the bladder. This particular shape provides the required load-bearing characteristics at each end portion, and improved extrusion barrier and deployment characteristics due to the greatly increased lateral stiffness of the wide central portion. In another embodiment, even wider intermediate portions are provided above and below a widened central portion. The invention has particular application to high expansion ratio packers which are relatively long due to tool anchoring requirements.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
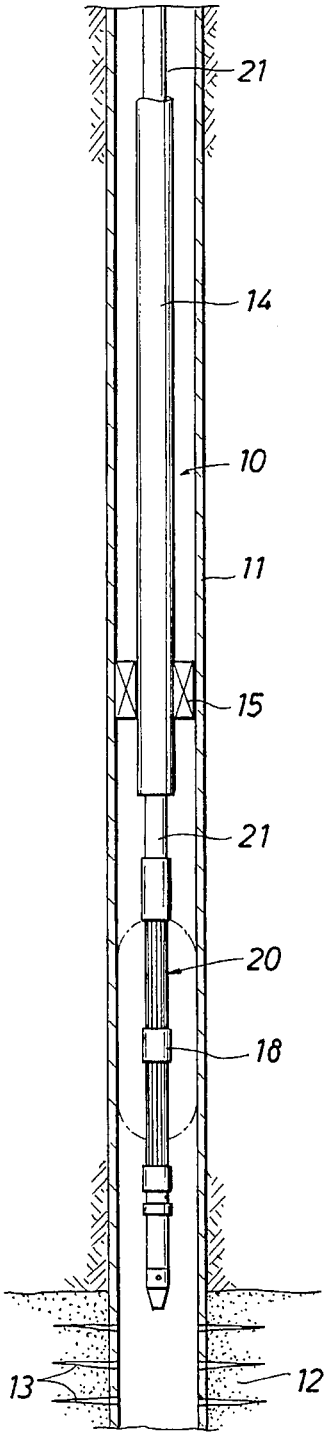
FIG. 1 is a schematic view of a well installation having an inflatable packer suspended therein on a running string.

Referring initially to FIG. 1, a well 10 that is lined with a casing 11 extends down through a formation 12 which is communicated with the casing bore by perforations 13. The production from the formation 12 flows to the surface through a production string 14 of tubing, and a packer 15 confines the flow and pressure to the tubing. In order to perform a well pressuring operation such as treating the formation 12 with various chemicals or agents to remedy some production problem that has arisen, a string of tools including an inflatable packer 20 is run through the production string 14 on coiled tubing 21. The coiled tubing 21 is injected into the production string 14 at the surface by a suitable unit (not shown) which has a storage reel, a guide, and injector assembly, pressure control equipment, and a pump for circulating fluid under pressure down through the coiled tubing 21, the packer 20 and out to the well bore therebelow. The tool string in which the inflatable packer 20 is included has various components which are familiar to those skilled in this art and need not be discussed here. In the application shown in the drawings the packer 20 is designed to have a high expansion ratio (greater than 2:1) between its expanded and retracted diameters for what can be called "through tubing" service work. For example the normally retracted outer diameter of the packer 20 can be about 2⅛ inches in order to pass through a 2½ inch i.d. production string 14 and then be expanded as shown in phantom lines to seal off against a casing 11 having an inner diameter of about 6½ inches. In this case the expansion ratio is 3:1.

Figure 2:
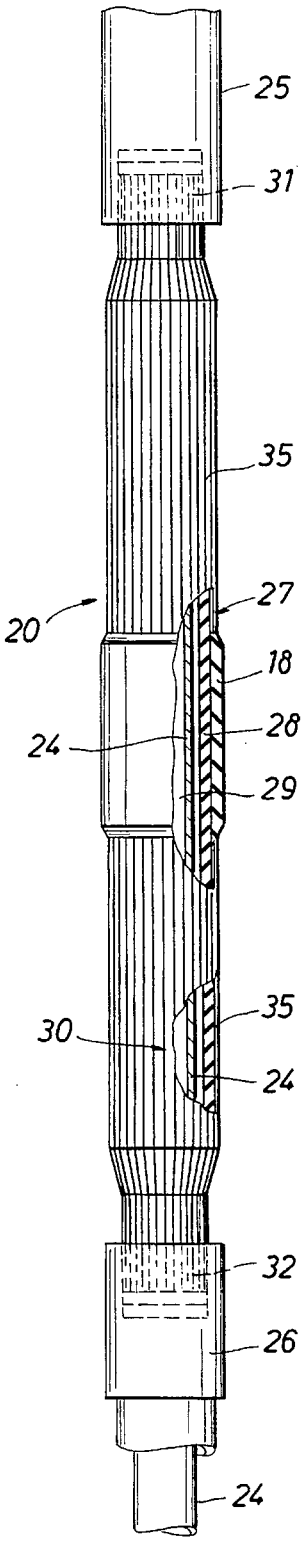
FIG. 2 is a longitudinal elevational view of a slat-type inflatable packer having a portion cut away to show the inner elastomer bladder.

As shown in FIG. 2, the inflatable packer 20 includes a central tubular mandrel 24 that carries upper and lower end fittings or collars 25, 26. A packer unit 27 surrounds the mandrel 24 and includes an inner elastomer bladder 28 and an outer reinforcement assembly 30. The end portions 31, 32 of the assembly 30, as well as the underlying end portions of the bladder 28, extend into respective internal annular recesses in the end fittings 25, 26 and are firmly secured and anchored therein. In a typical arrangement, the lower fitting 26 can slide upward along the mandrel 24 and relatively toward the upper fitting 25 as the packer unit 27 is inflated and expanded. Fluid under pressure to inflate the unit 27 comes down through a passage (not shown) in the upper end fitting 25 and into the annular space between the bladder 28 and the mandrel 24, the fitting passage being communicated by other passageways with the lower end of the coiled tubing 21. The central bore 29 of the mandrel 24 leads to a lower port through which chemicals can be injected into the wellbore under pressure below the packer assembly 20. An elastomer packer sleeve 18 surrounds a central portion of the reinforcement assembly 30 and is expanded along with the reinforcement and the central portion of the bladder 28. The sleeve 18 sealingly engages the inner wall of the casing 11 to prevent fluid leakage.

The reinforcing assembly 30 is constituted by a number of elongated relatively thin metal slats 35 which partially overlap one another around the circumference of the elastomer bladder 28. Thus as the diameter of the bladder 28 is increased during expansion, adjacent ones of the slats 35 slide across one another as their composite diameter is increased also. The individual slats 35 are wide enough so that when the bladder 28 is fully expanded the central portions of the slats are pressed against the inner walls of the casing 11 with some overlap remaining so that there are no cracks or other openings through which portions of the bladder might otherwise extrude and be damaged. The slats 35 frictionally grip the well casing wall and prevent longitudinal movement of the packer 20 during a well pressuring operation, and also provide the principle load bearing members which carry the pressure forces on the packer due to the greater pressures in the well bore below the packer than in the annulus above it. As noted above, the sleeve 18 prevents fluid leakage between the inner wall of the casing 11 and the outer surface of the reinforcement 30.

Figure 3:
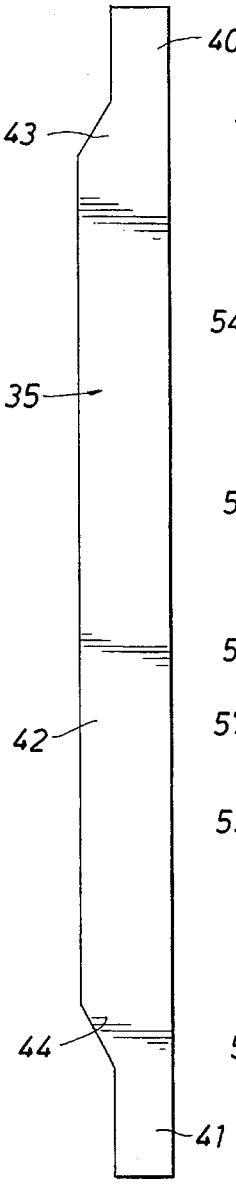
FIG. 3 is a somewhat enlarged plan view of a reinforcing slat design in accordance with the present invention.

In prior devices of this type, each of the slats has been a rectangular member having a constant width throughout its length. In accordance with this invention, for example as shown in FIG. 3, the opposite end portions 40 and 41 of each slat 35 are narrow while one side portion 42 is widened substantially at tapered transition zones 43, 44. In a typical example, the reinforcement assembly 30 can include 50 slats 35 which are ½ inch wide at the end portions 40 and 41 and which taper at 43, 44 to a central portion which is 1 inch wide. The thickness of each slat 35 can be about 0.030 inches. This design is contrasted with a prior arrangement where there would have been 100½ inch wide slats that were 0.015 inch thick. The slats 35 have the same minimum yield strength and extrusion barrier characteristics, but a much better deployment characteristic due to increased lateral stiffness, which is increased by a factor of 8 on account of being twice as wide in the central portion 42 as in the end portions 40, 41. Particularly where an inflatable packer 20 has a high expansion ratio and is relatively long due to anchoring requirements, the deployment characteristic of the slat assembly is of overriding importance.

Figure 4:
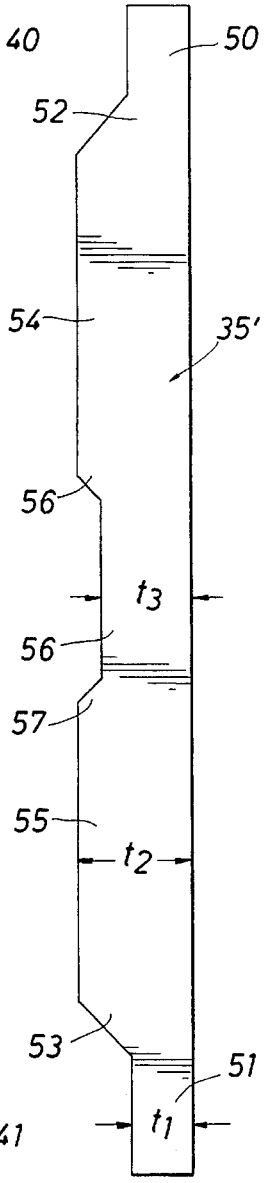
FIG. 4 is another enlarged plan view showing another slat geometry in accordance with this invention.

In another embodiment of the present invention which is shown in FIG. 4, each slat 35' has narrow end portions 50, 51 of width $t_1$ which widen at transition regions 52, 53 to upper and lower intermediate sections 54, 55 having a greater width $t_2$. In the central region 56 of each slat 35' the sections 54, 55 are narrowed at transitions 56, 57 to a width $t_3$ which is greater than $t_1$, but less than $t_2$. When the reinforcement assembly 30 has been packaged around the mandrel 24 together with the bladder 28, the elastomer sleeve 18 is positioned such that it surrounds the reinforcement assembly in the central region 56 where the slats 35' have width $t_3$. The further increased widths $t_2$ of each slat section 54, 55 provides an even stiffer assembly in the lateral direction in order to control the shape and deployment of the packer unit 27 during expansion.

OPERATION

In use and operation, the inflatable packer 20 is assembled as shown in the drawings and, together with associated tool string components, is run into the production string 14 on the lower end of the coiled tubing 21. After the packer 20 emerges from the lower end of the string 14, it is lowered until it is adjacent but above the perforations 13. Then the tool string is halted and the coiled tubing 21 manipulated to condition various components for a well pressuring operation, after which the surface pumps are started to inflate and expand the packer 20.

Pressurized fluids pass into the interior of the elastomer bladder 28 and exert pressure forces in all directions therein to cause expansion as shown in dash lines in FIG. 1. As the bladder 28 expands, the mid-portions of the slats 35 or 35' slide laterally relative to one another but provide a circumferentially continuous reinforcement throughout the expansion range. The greater respective widths of the slats 35 and 35', and the much greater lateral stiffness attributable thereto, produces significantly improved deployment during expansion so that the slats have uniform overlapping distances for any degree of expansion. The narrower width at the end portions 40, 41, 50, 51 of each slat 35 or 35' produces the required load bearing cross-section at each end fitting 25, 26 and simplifies the packaging of slats within the end fitting recesses. The wider portions of each slat design provide the required extrusion barrier for the bladder 28.

Even with the slat design shown in FIG. 4, the diameter of the overall slat assembly or carcass at sections 54, 55 is approximately equal to the o.d. of the packer assembly 20. The reduction in width to $t_3$ in section 56 allows the seal sleeve 18 to be molded in place within such o.d. The overall design of each slat embodiment includes substantially increased widths between narrow end portions so that very high increases in lateral stiffness are attained. The seal sleeve 18 can have a reasonable thickness in each case, and in the FIG. 4 embodiment is somewhat protected in that it rests in the slat regions 56 between wider sections 54, 55. This feature can be significant during packer assembly retrieval through a restriction because there is much lesser tendency for the sleeve 18 to be skinned off.

To retrieve the tool string from the well, the inflation pressure is reduced and packer unit tends to inherently retract toward its original diameter on account of the resilience of the elastomer bladder 28 at the slats 35 or 35'. Then the coiled tubing 21 and the tool string can be pulled up through the production tubing 14 to the surface as the coiled tubing is wound back onto its reel. If desired, the packer 20 can be reinflated several times where other service work needs to be done on the same trip, at the same or other downhole locations.

It now will be recognized that an inflatable packer having a new and improved slat-type reinforcement on the outside of the elastomer bladder has been disclosed. Since certain changes or modifications may be made in the disclosed embodiments without departing from the inventive concepts involved, it is the aim of the appended claims to cover all such changes and modifications falling within the true spirit and scope of the present invention.

What is claimed is:

1. In an inflatable packer having an elastomer bladder surrounded by a reinforcement that provides an extrusion barrier for said bladder, said reinforcement comprising a plurality of longitudinally extending flexible slats arranged in circumferential partially overlapping relationship, each of said slats having opposite end portions and at least one intermediate portion, said end portions and intermediate portions having different widths.

2. The packer of claim 1 wherein each slat has one side edge that is straight throughout its length.

3. The packer of claim 1 wherein said intermediate portion is approximately twice as wide as said end portions.

4. The packer of claim 2 wherein said central portion has a straight side edge that is opposite said one side edge and is joined to said end portions by inclined edges at each end thereof.

5. The packer of claim 1 wherein each slat where an intermediate portion is arranged on respective opposite sides of a central portion of said slat, each of said intermediate portions being wider than said central portion and said end portions.

6. The packer of claim 5 further including elastomer sleeve means surrounding said central portions and adapted to sealingly engage a surrounding well conduit wall upon inflation of said bladder.

7. An inflatable packer apparatus comprising: a body member; upper and lower end fittings on said body member; an elastomer bladder surrounding said body member and adapted to be inflated and expanded outward in response to internal fluid pressure, said bladder having upper and lower end portions; a reinforcement surrounding said elastomer bladder and having upper and lower end portions; means for connecting said upper end portions to said upper end fitting and said lower end portions to said lower end fitting; said reinforcement including a plurality of longitudinally extending metal slats arranged such that a side portion of each slat overlaps a side portion of an adjacent slat so that as said elastomer bladder is expanded the extent of overlap is gradually reduced but not eliminated; each of said slats having a central portion that is substantially wider than the end portions thereof.

8. The apparatus of claim 7 wherein said central portions are approximately twice as wide as said end portions to substantially increase the lateral stiffness of said reinforcement.

9. The apparatus of claim 8 wherein each of said slats has one side edge that is straight, each end portion thereof and said central portion having opposite side edges which are straight and parallel to said one side edge.

10. The apparatus of claim 9 wherein said opposite side edges of said end portions are joined to said opposite side edge of said central portion by oppositely inclined side edges.

11. The apparatus of claim 7 wherein each slat has intermediate portions on respective opposite sides of said central portion, each of said intermediate portions being wider than said central portion.

12. The apparatus of claim 11 wherein each of said slats has one side edge that is straight, and wherein each end portion thereof, said central portion and each of said intermediate portions has opposite side edges which are straight.

13. The packer of claim 11 further including said sleeve means surrounding said central portion and adapted to be expanded during expansion of said elastomer bladder into sealing engagement with a well conduit wall.

* * * * *